US006862894B1

(12) United States Patent
Miles, Sr.

(10) Patent No.: US 6,862,894 B1
(45) Date of Patent: Mar. 8, 2005

(54) ADAPTIVE AUXILIARY CONDENSING DEVICE AND METHOD

(75) Inventor: Donald R. Miles, Sr., 1662 Stevens Rd., Eagle Point, OR (US) 97524

(73) Assignee: Donald R. Miles, Sr., Eagle Point, OR (US)

( * ) Notice: Subject to any disclaimer, the term of this patent is extended or adjusted under 35 U.S.C. 154(b) by 3 days.

(21) Appl. No.: 10/773,006

(22) Filed: Feb. 4, 2004

(51) Int. Cl.[7] ..... F25B 27/00
(52) U.S. Cl. ..... 62/238.6; 62/181; 62/184
(58) Field of Search ..... 62/238.6, 178, 62/180, 181, 183, 184, 126

(56) References Cited

U.S. PATENT DOCUMENTS 1,790,237 A 1/1931 King ..... 62/196.4
2,125,542 A 8/1938 Catterlin ..... 62/259.1

(Continued)

*Primary Examiner*—Marc Norman
(74) *Attorney, Agent, or Firm*—Lumen Intellectual Property Services, Inc.

(57) ABSTRACT

A water-cooled auxiliary condenser device 200 receives refrigerant from an external refrigeration system 210 just downstream from its air-cooled condenser 110. The refrigerant passes through a water-cooled condenser 250, and the refrigerant state is sensed by a temperature or pressure sensor 226. If the sensed state of the refrigerant rises above a first threshold, the flow of water through the water-cooled condenser 250 is increased, e.g., turned ON, using a controllable water valve 234. When the sensed state of the refrigerant drops below a second threshold, the water flow through the water-cooled condenser 250 is decreased, e.g., turned OFF. The refrigerant returns to the refrigeration system just upstream from its liquid receiver 120. In the event that air-cooled condenser 110 fails, device 200 automatically activates the water-cooled condenser 250 to maintain safe refrigeration temperatures in the appliance. When not required, device 200 remains passive and does not use any water or electric.

15 Claims, 2 Drawing Sheets

U.S. PATENT DOCUMENTS

| | | | | | |
|---|---|---|---|---|---|
| 2,453,131 | A | | 11/1948 | Hubbard | 62/197 |
| 2,691,273 | A | | 10/1954 | Kramer | 62/175 |
| 2,943,457 | A | | 7/1960 | Wile Etal | |
| 3,122,033 | A | | 2/1964 | Sullivan | 62/157 |
| 3,230,733 | A | | 1/1966 | Rutishauser et al. | 62/256 |
| 4,089,667 | A | * | 5/1978 | Jonsson | 62/238.6 |
| 4,199,955 | A | * | 4/1980 | Jonsson | 62/79 |
| 4,292,813 | A | | 10/1981 | Paddock | 62/158 |
| 4,373,346 | A | * | 2/1983 | Hebert et al. | 62/79 |
| 4,404,814 | A | * | 9/1983 | Beasley et al. | 62/171 |
| 4,530,219 | A | | 7/1985 | Aleksandrow | 62/503 |
| 4,742,689 | A | | 5/1988 | Lowes | 62/197 |
| 4,974,427 | A | | 12/1990 | Diab | 62/505 |
| 5,195,328 | A | | 3/1993 | Davis | 62/117 |
| 5,253,484 | A | | 10/1993 | Corman et al. | 62/239 |
| 5,297,397 | A | * | 3/1994 | Pointer | 62/238.6 |
| 5,400,609 | A | | 3/1995 | Sjoholm et al. | 62/113 |
| 5,474,120 | A | | 12/1995 | Severson et al. | 165/296 |
| 5,553,463 | A | * | 9/1996 | Pointer | 62/238.6 |
| 5,946,925 | A | | 9/1999 | Williams et al. | 62/196.4 |
| 6,035,655 | A | | 3/2000 | Hare et al. | 62/259.2 |
| 6,092,377 | A | | 7/2000 | Tso | 62/173 |
| 6,213,194 | B1 | | 4/2001 | Chrysler et al. | 165/80.3 |
| 6,334,331 | B1 | | 1/2002 | Chen et al. | 62/434 |
| 6,427,460 | B1 | | 8/2002 | Zanon | 62/174 |
| 6,557,372 | B1 | | 5/2003 | Ozawa et al. | 62/507 |
| 6,675,591 | B2 | | 1/2004 | Singh et al. | 62/129 |
| 2003/0159458 | A1 | | 8/2003 | Fang et al. | 62/305 |

* cited by examiner

ADAPTIVE AUXILIARY CONDENSING DEVICE AND METHOD

FIELD OF THE INVENTION

This invention relates generally to refrigeration systems. More specifically, it relates to air-cooled refrigeration systems and auxiliary water-cooled condensers for use with such systems.

BACKGROUND OF THE INVENTION

Common residential and commercial refrigeration appliances rely on air-cooled condensers as part of the refrigeration cycle. In a conventional refrigeration system of this type, the condenser dissipates heat from the warm, high-pressure refrigerant fluid into the ambient air. Often a fan promotes this dissipative heat transfer by creating a flow of air over the surface of the condenser. In normal operation, sufficient heat is dissipated by the condenser in the high-pressure portion of the cycle so that when the fluid passes through the evaporator in the low-pressure portion of the cycle, its temperature is low enough to produce the required cooling.

In many systems the compressor turns on intermittently, cycling the fluid and producing cooling only when necessary. If heat is not efficiently dissipated at the condenser, however, the cooling capacity of the evaporator will be reduced. This will cause the compressor to turn on more frequently and/or run for longer periods of time, shortening the life of the compressor and consuming more energy. Inefficient heat transfer at the condenser can thus increase the probability of compressor failure. Moreover, if the heat transfer efficiency at the condenser drops below a critical level, the evaporator will no longer be able to absorb enough heat to maintain the required refrigeration temperature, even if the compressor runs continuously. Therefore, in order to maintain food safety, prevent food poisoning, and reduce the spoiling of food or other perishable materials, it is critical that air-cooled condensers efficiently dissipate heat to the the ambient air outside the unit.

Unfortunately, common refrigeration appliances often experience a significant degradation in condenser efficiency. For example, it is common for these appliances to be installed in locations where the ambient air has a high temperature, e.g., in hot kitchens, near ovens, grills, or ranges. Another common cause of condenser inefficiency is an obstruction of the airflow, e.g., by a plastic bag covering the condenser or blocking the air intake. If the fan fails, this will obviously reduce the airflow and condenser efficiency as well. It is also common for grease, dirt, lint, or some combination of these to collect on the surface of the condenser, creating an insulating layer that reduces the heat transfer to the ambient air. To make matters worse, several of these factors may be present at once, compounding the problem.

When condenser inefficiency causes compressor failure or becomes so high that safe refrigeration temperatures can not be maintained, it is critical that the appliance be repaired quickly to prevent the spoiling of perishable items. Replacing or repairing the appliance, however, can be expensive and time-consuming.

To avoid the above drawbacks of air-cooled condensers, some commercial refrigeration appliances use water-cooled condensers instead. These systems, however, require a continuous flow of water to dissipate the heat from the condenser. This use of water increases the operating costs of the appliance and, in some circumstances, is not feasible when the water supply is limited (e.g., when water is available only from a well). Because of these disadvantages, water-cooled refrigeration appliances are often not affordable or practical, forcing people to continue to use common air-cooled refrigeration appliances. Consequently, there remains a need for a way to easily and inexpensively address the various problems associated with inefficient condensers in conventional air-cooled refrigeration appliances.

SUMMARY OF THE INVENTION

It is an object of the present invention to solve various problems associated with air-cooled refrigeration appliances. In one aspect of the invention, an adaptive water-cooled auxiliary condenser device is provided that can be attached to an existing refrigeration appliance. The device is self-contained, inexpensive, and easily connected. Once attached, the device provides automatic, on-demand water cooling. The device has a refrigerant fluid line, a water line, and an electrical circuit. The refrigerant fluid line has a refrigerant fluid inlet, a refrigerant fluid heat exchange section, a refrigerant fluid state sensor, and a refrigerant fluid outlet. The water line has a water inlet, a controllable water flow valve, a water heat exchange section, and a water outlet. The water heat exchange section and the refrigerant fluid heat exchange section are in heat exchange relationship. The electrical circuit is connected to the refrigerant fluid state sensor and the controllable water flow valve such that the water flow valve is opened when a sensed refrigerant fluid state rises above a first predetermined threshold value and the water flow valve is closed when the sensed refrigerant fluid state falls below a second predetermined threshold value. The electrical circuit may also include a warning indicator such as a light or sound alarm.

The self-contained device is preferably housed in a metal box that may be easily installed by connecting its water inlet and outlet to a locally available water source and drain, respectively, connecting its refrigerant fluid inlet and outlet to the high-pressure line of a refrigeration appliance so that the device is just downstream from the appliance's air-cooled condenser, and connecting the electrical circuit to a power supply.

In operation, the device receives a refrigerant fluid from a high-pressure portion of the refrigeration system downstream from its air-cooled condenser. The refrigerant passes through the device and returns to the high-pressure portion of the refrigeration system just upstream from the liquid receiver. In the device, the received refrigerant fluid passes through a water-cooled condenser, and its state is sensed by a sensor, e.g., a pressure or temperature sensor. If the sensed state of the refrigerant fluid rises above a first predetermined threshold value, the water flow through the water-cooled condenser is increased. This first threshold value, for example, may be set so that the water flow is turned on only when the air-cooled condenser efficiency drops significantly (e.g., if the ambient air temperature becomes very high or the air flow around the condenser is temporarily obstructed). When the sensed state of the refrigerant fluid drops below a second predetermined threshold value, the water flow through the water-cooled condenser is decreased. For example, the second threshold value may be set so that the water flow turns off when the air-cooled condenser efficiency returns to normal (e.g., if the ambient air temperature returns to normal or an obstruction to the air flow is removed). The refrigeration system will then operate as a normal air-cooled system until the sensed state again rises.

Because the water flow turns on only when needed (i.e., when the air-cooled condenser efficiency drops below normal) the device does not use electric power or water under normal operating conditions. The refrigerant simply flows transparently through the device. If needed, however, the flow of water provides additional cooling that maintains safe refrigeration temperatures in the appliance. In this case, the warning indicator provides an alert that the appliance should be serviced. However, servicing is not critical since the back-up water cooling will maintain safe refrigeration temperatures. The device therefore provides a back-up which may be installed to repair, prevent or safeguard against failures in air-cooled refrigeration appliances. The device is inexpensive and may be easily installed by a service technician.

DETAILED DESCRIPTION

Figure 1:
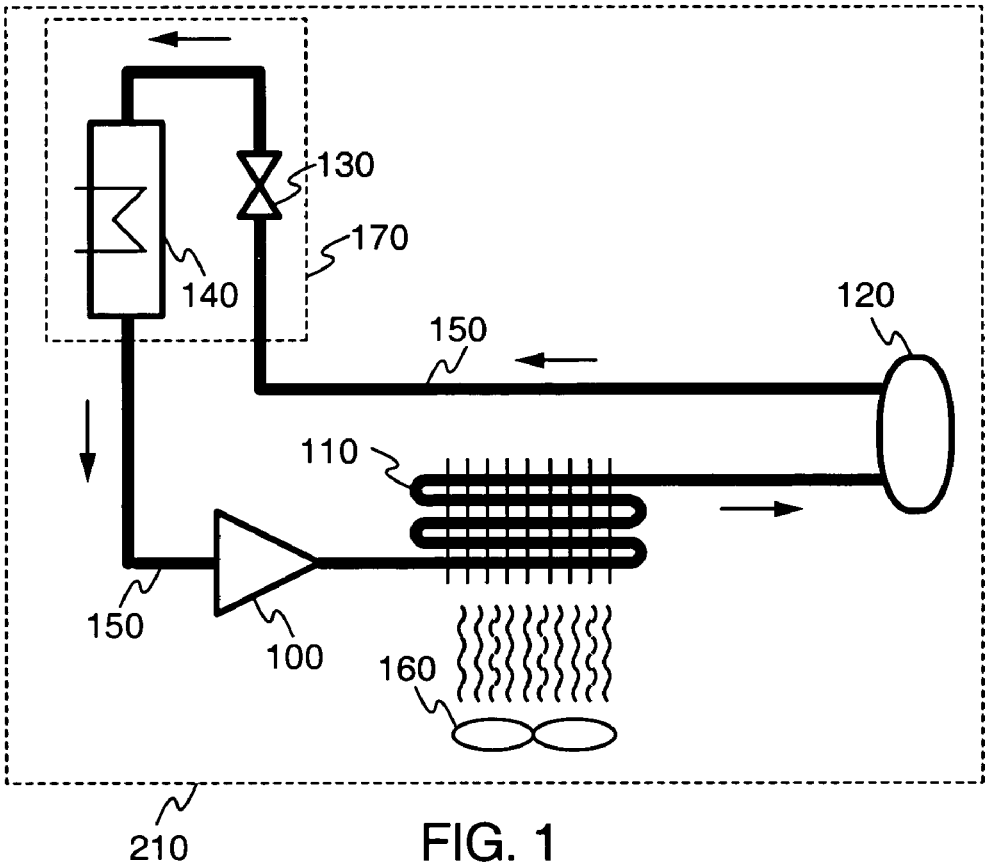
FIG. 1 (Prior Art)
FIG. 1 is a schematic diagram of a conventional air-cooled refrigeration system.

Particular embodiments of the present invention will now be described in detail with reference to the drawing figures. The purpose and function of the present invention is best understood by first reviewing the structure and operation of a conventional air-cooled refrigeration system, as illustrated in FIG. 1. The system includes the following components connected in series to form a closed cycle: a compressor 100, air-cooled condenser 110, receiver 120, expansion valve 130, and evaporator 140. These components are connected by a refrigerant fluid line 150. Optionally, a fan 160 may be associated with air-cooled condenser 110. The system may be understood as being divided by the compressor 100 and expansion valve 130 into a high-pressure portion and a low-pressure portion. The high-pressure portion includes the condenser 110 and receiver 120, while the low-pressure portion includes the evaporator 140.

In operation, a gaseous refrigerant fluid enters the compressor 100 which increases the pressure (and, consequently, the temperature) of the refrigerant fluid. This compressed fluid then flows downstream into the air-cooled condenser 110. Under normal operation conditions, the condenser dissipates heat into the ambient air, cooling the high-pressure refrigerant fluid flowing through it. As a result of this cooling, the gaseous refrigerant fluid (or a significant portion of it) condenses to a liquid state. The heat dissipation may be facilitated by fan 160 designed to promote heat transfer from the condenser to the ambient air by increasing the flow of air over the surface of the condenser 110. The condensed fluid passes from the condenser 110 into a receiver 120, and from there to an expansion valve (or metering device) 130. Due to the drop in pressure through the expansion valve 130, the refrigerant fluid passing through the valve changes from a liquid state to a gaseous state. As a result of this evaporation, the temperature of the fluid drops. This cold, low-pressure fluid then flows through a cold plate (or evaporator) where it absorbs heat and thus provides cooling to a refrigerated enclosure 170. The fluid then flows back to the compressor 100 to repeat the cycle.

Typically, a thermostat (not shown) measures the temperature within the enclosure 170 and turns on the compressor 100 when this temperature rises above a predetermined threshold. If the refrigeration system is operating normally, the compressor 100 causes the refrigerant to flow through the cycle and reduce the temperature within the enclosure 170. Once the temperature falls back down to a predetermined threshold, the compressor 100 turns off. However, if heat is not efficiently dissipated at the condenser 110 then there will be a corresponding reduction in the cooling capacity at the cold plate 140, and this will cause the compressor 100 to turn on more frequently and/or run for longer periods of time. This frequent on/off cycling of the compressor shortens its life, uses more energy, and increases the chances of compressor failure. In the worst case, the heat-transfer efficiency at the condenser 110 is so low that, even if the compressor runs continuously, there is so little cooling at cold plate 140 that the temperature inside enclosure 170 remains above the thermostat threshold. This refrigeration failure can result the spoiling of food or other perishable materials.

The present invention provides solutions to these problems with air-cooled refrigeration systems. If such a system is found to have a low-efficiency condenser, then the invention provides a way to quickly, easily, and inexpensively return the system to normal operation. Moreover, even if a refrigeration system does not yet have a problem with its air-cooled condenser, the invention provides a way to prevent refrigeration failure in the event that such problems develop in the future.

Figure 2:
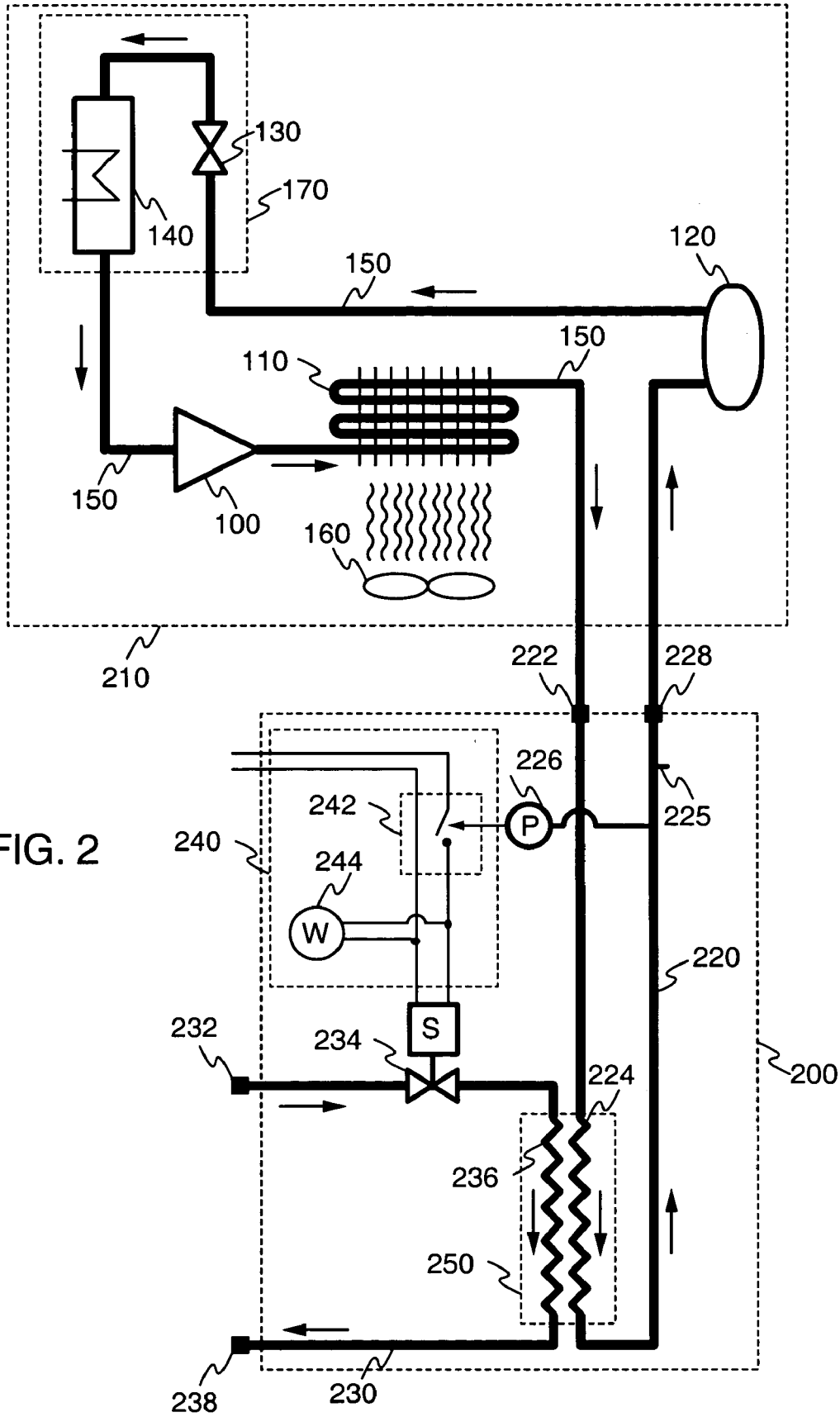
FIG. 2 is a schematic diagram of an adaptive auxiliary condenser device according to one embodiment of the invention, as it may be connected to a conventional air-cooled refrigeration system.

FIG. 2 is a schematic illustration of an embodiment of the invention as it may be connected to the conventional air-cooled refrigeration appliance just discussed in relation to FIG. 1. According to this embodiment, an adaptive water-cooled auxiliary condenser device 200 is connected to the refrigerant fluid line 150 in the high-pressure portion of the conventional refrigeration system 210. More specifically, the device is preferably inserted in series downstream from the air-cooled condenser 110. More preferably, it is inserted between the condenser 110 and the receiver 120. As will be discussed below in relation to other embodiments, however, other ways of inserting the device into the refrigeration cycle are also possible. It should be noted that, advantageously, there is no need to electrically connect the device 200 to the existing refrigeration system 210. Only a connection to the refrigerant fluid line 150 is used. The device 200 is preferably housed in a casing (not shown) which may be conveniently mounted on the side of the refrigeration system 210, or simply set on a surface next to or on top of system 210. The device 200 also can be mounted on a wall next to the system 210 or on a wall in an adjacent room by passing connecting refrigerant lines through the wall. All else being equal, it is preferably to install the device close to the appliance as practical. The size of the device selected for installation is normally selected to match the B.T.U. (British thermal units) requirements from the compressor numbers of the refrigeration system.

Once connected, the device 200 provides automatic, on-demand water cooling of the refrigerant fluid. When the refrigeration system 210 is operating normally, i.e., when the air-cooled condenser 110 is providing sufficient cooling, the device 200 remains passive, allowing the refrigerant to pass transparently through it. In the event that the air-cooled condenser 110 fails to provide sufficient cooling, however, the device 200 automatically performs water-cooling of the refrigerant, thereby providing the required cooling needed to return the refrigeration system 210 to normal operation.

The device 200 has a refrigerant fluid line 220, a water line 230, and an electrical circuit 240. The refrigerant fluid line 220 of the device 200 is connected in series with the refrigerant fluid line 150 of the refrigeration system 210. As shown in the figure, the connections may be made using conventional hoses or tubing to connect refrigerant fluid inlet 222 to the fluid line 150 located just downstream from condenser 110 and to connect refrigerant fluid outlet 228 to the fluid line 150 located just upstream from receiver 120. Due to the added length of the fluid line in the refrigeration cycle, the system may require additional refrigerant to be added.

The fluid line 220 within the device includes a refrigerant fluid heat exchange section 224 and a refrigerant fluid state sensor 226. Fluid line 220 also includes a gauge port 225 where a gauge is attached when calibrating the device, as will be explained in more detail below. Refrigerant fluid flowing out of condenser 110 flows into inlet 222, through heat exchange section 224, is sensed by fluid state sensor 226, flows out through outlet 228 and on to receiver 120. Fluid state sensor 226 may include a pressure sensor, temperature sensor, or other sensor that provides an indirect way of determining the pressure or temperature state of the fluid. For example, sensor 226 may provide a binary on/off electrical signal indicating whether or not the sensed state of the fluid is above or below a predetermined threshold value. Preferably, the sensor uses two threshold values, one for the off-on transition and the other for the on-off transition. For example, if the first threshold is set at 250 psi and the second is set at 200 psi, then the off-on transition will take place when the pressure rises above 250 psi, while the on-off transition will not take place until the pressure drops below 200 psi. This use of two threshold values prevents on-off oscillation near a single transition temperature. In this embodiment, fluid state sensor 226 and a switch 242 are integrated into a single pressure control device that controls whether or not power is delivered to valve 234, as will be described below.

The water line 230 has a water inlet 232, a controllable water flow valve 234, a water heat exchange section 236, and a water outlet 238. Using conventional pipes, hoses, or tubing, water line 230 is connected at inlet 232 to a source of cool water (not shown) and is connected at outlet 238 to a drain, sink, sewer or other water line (not shown) which may be used to receive water. Water heat exchange section 236 is thermally coupled to refrigerant fluid heat exchange section 224, both of which constitute a condenser/heat-exchanger 250 wherein heat exchange can take place between the cool water in water line 230 and the refrigerant flowing through refrigerant fluid line 220. Heat exchanger 250 may be implemented using various types of heat exchanger designs including, for example, a coaxial type or a tube—tube type. The amount of heat exchange between water and refrigerant depends upon the temperature difference between the water and refrigerant and upon the flow rates of the fluids. The flow of cool water passing through water line 230 is regulated by controllable valve 234, e.g., a solenoid valve or similar device that allows electrical control of water flow. For example, valve 234 may be a simple solenoid valve with two on/off states. When valve 234 is closed and water does not flow through water line 230, the stagnant water in heat exchange section 236 will come into thermal equilibrium with the refrigerant fluid flowing through heat exchange section 224. Consequently, the water will produce little or no cooling of the refrigerant and the device 200 will be transparent to the operation of refrigeration system 210. When valve 234 is opened and water flows through water line 230, the water passes through water heat exchange section 236, thereby cooling the refrigerant. To assure the accuracy of sensor 226, the water and refrigerant fluids flow in the same direction (i.e., not in a counter-current manner) through these heat exchange sections 224 and 236. It also should be noted that valve 234 may be positioned either upstream or downstream relative to heat exchange section 236 since either position will permit it to regulate the water flow through the entire water line 230. However, valve 234 is preferably positioned upstream from heat exchange section 236 since this will help reduce water loss in case the heat exchange section develops a leak.

Electrical circuit 240 is connected to the refrigerant fluid state sensor 226 and the controllable water flow valve 234. Circuit 240 is also connected to a power source (not shown), which is typically external, e.g., a standard 120 VAC electrical outlet. A control circuit 242 (e.g., switch 242 integrated within the pressure control device) receives electrical signals from refrigerant fluid state sensor 226. These electrical signals are correlated to the temperature and/or pressure of the refrigerant fluid flowing through fluid line 220 downstream from the heat exchange section 224. Switch 242 then sends control signals to water flow valve 234 so that the water flow valve is opened when a sensed refrigerant fluid state rises above a first predetermined threshold value and the water flow valve is closed when the sensed refrigerant fluid state falls below a second predetermined threshold value.

In this embodiment circuit 240 includes a simple electrical connection between pressure control device (comprising fluid state sensor 226 and switch 242) and water flow valve 234 (a two-state solenoid valve). Thus, when fluid state sensor 226 detects a fluid state rising above a first threshold, switch 242 in the pressure control device allows power to flow to solenoid valve 234, thereby allowing water to flow through water line 230. This flow of water cools the refrigerant fluid in line 220. The flow rate when the valve 234 is open should be sufficiently high to provide the required cooling. However, in order to conserve water, the flow rate should not be unnecessarily high. When the refrigerant fluid state drops below a second threshold value, the fluid state sensor 226 detect this drop and makes an on-off transition. This transition causes circuit 240 to cut power from solenoid valve 234, which stops the flow of water. Note that just after the valve is closed, stagnant water in the heat exchange section 236 will continue to provide residual cooling of the refrigerant fluid in heat exchange section 224 until the stagnant water reaches thermal equilibrium with the refrigerant fluid. The electrical circuit 240 preferably includes an optional warning indicator 244 such as a light or sound alarm. This provides a warning that the air-cooled condenser of the refrigeration system is not providing sufficient cooling to maintain proper refrigeration.

Figure 3:
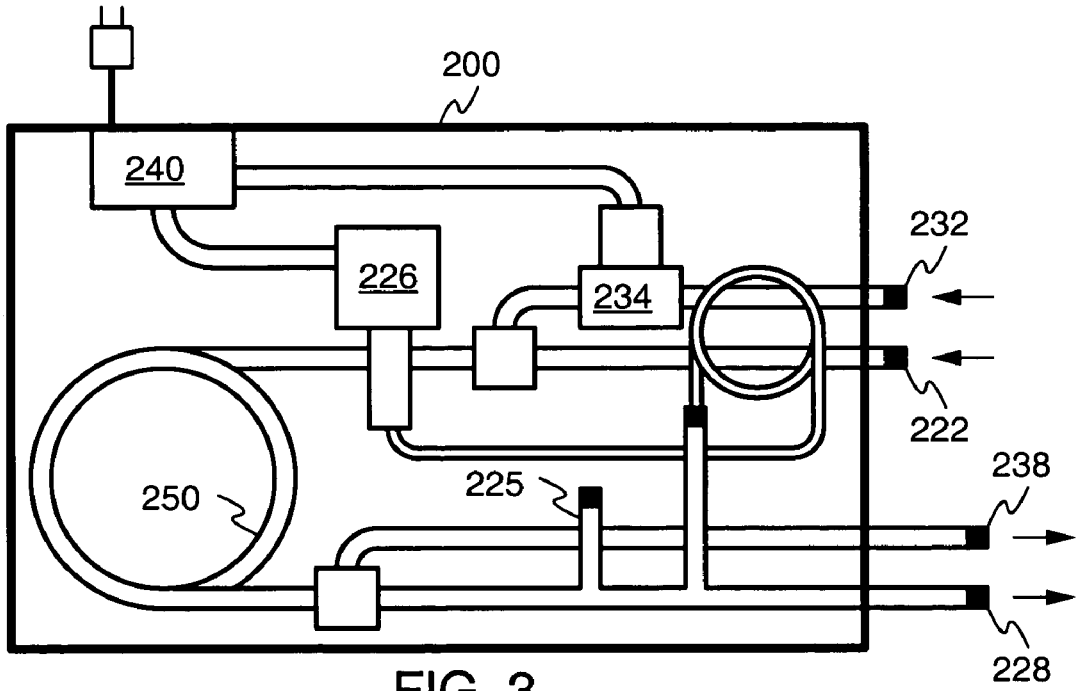
FIG. 3 is a cut-away illustration of an adaptive auxiliary condenser device according to an embodiment of the invention.

FIG. 3 is a cut-away illustration of an adaptive auxiliary condenser device 200 according to an embodiment of the invention. Refrigeration fluid enters the device through inlet 222, passes through coaxial water-cooled heat exchanger 250 and exits through outlet 228. Cool water enters through inlet 232, passes through solenoid valve 234, coaxial heat exchanger 250, and exits through outlet 238. Pressure sensor 226 is connected via circuit 240 to solenoid valve 234 to control the water flow depending on the sensed pressure of the refrigerant fluid.

In other embodiments, more sophisticated sensor, valve, and control circuitry may be used. For example, sensor 226 may provide output signals corresponding to a plurality of discrete or continuous fluid states and valve 234 may have multiple discrete or continuous states corresponding to various controllable flow rates. Control circuit 240 connects sensor 226 to valve 234 so that the various sensed fluid states result in various corresponding water flow rates. In general, the higher the sensed temperature and/or pressure, the higher the controlled water flow rate. Although these embodiments provide finer control over the rate of water flow, simple two-state valves provide adequate control for most purposes and have the advantage of keeping the device 200 simple and inexpensive.

In operation, the device 200 of the preferred embodiment receives refrigerant fluid from the high-pressure portion of the refrigeration system 210 just downstream from its air-cooled condenser 110. The received refrigerant fluid passes through a water-cooled condenser/heat-exchanger 250 comprising heat exchange sections 224 and 236, and the fluid state is sensed by a sensor 226, e.g., a pressure or temperature sensor. The refrigerant fluid then returns to the high-pressure portion of the refrigeration system 210 just upstream from receiver 120. The fluid otherwise flows through refrigeration system 210 cycle as described earlier.

If the sensed state of the refrigerant fluid at sensor 226 rises above a first predetermined threshold value, the water flow through the water-cooled condenser 250 is increased. This first threshold value, for example, may be set so that the water flow is turned on by valve 234 only when the efficiency of air-cooled condenser 110 drops significantly (e.g., if the ambient air temperature becomes very high or the air flow around the condenser is temporarily obstructed). When the sensed state of the refrigerant fluid drops below a second predetermined threshold value, the water flow through the water-cooled condenser 250 is decreased. For example, the second threshold value may be set so that the water flow at valve 234 turns off when the air-cooled condenser efficiency drops back to normal (e.g., if the ambient air temperature returns to normal or an obstruction to the air flow is removed).

The threshold values of the fluid state sensor 226 are preferably adjustable and are calibrated during installation to ensure proper operation. For example, if the specifications for refrigeration appliance 210 provide values for a normal temperature or pressure range at the output of the condenser 110, then the first threshold value may be set at a value above the highest value of this normal range. The second threshold value may be set to a value below the first threshold value so that a predetermined normal suction pressure (e.g., differential) is maintained. During calibration of the threshold values at installation time, a gauge may be attached to gauge port 225 and when it indicates a specified threshold pressure the sensor 226 can be set to transition at that pressure.

If specifications are not known, a technician may calibrate the device as follows. Prior to connecting the device, the technician turns on the malfunctioning refrigeration system 210 and documents both the high-pressure and the suction pressure of the system. The high pressure may be used as an initial estimate for the first pressure threshold for the device calibration. As needed, he then cleans the air-cooled condenser 110, removes any obstruction to airflow over the condenser, repairs the fan, and ensures that the ambient temperature is normal. He then documents both pressures of the system again to determine the normal operating pressures. The normal high pressure may be used as an initial estimate for the second pressure threshold for the device calibration.

The device 200 may be connected to the refrigeration system 210 as follows. First all the refrigerant is evacuated from the fluid line 150 into a recovery bottle until both pressures read zero. The refrigerant line 150 is then cut between the air-cooled condenser 110 and the liquid receiver 120. The inlet 222 to the device is connected to the line coming from the condenser 110, while the outlet 228 from the device is connected to the line going to the liquid receiver 120. Then the pressure in the fluid line is preferably pumped down to a vacuum for about 45 minutes. Meanwhile, the water inlet 232 and outlet 238 are connected. After a vacuum is established the refrigerant that was recovered is replaced, preferably into the high-pressure side of the system. When most of the refrigerant has been replaced, the system 210 can be started and the rest of the refrigerant can be added to the low-pressure end. The device 200 is then turned on and allowed to provide auxiliary cooling to the system. After the system runs for a few minutes the same type refrigerant is added until the system sight glass shows full and no bubbles are present.

The first threshold value of pressure control 226 may be initially set to the high pressure that was first documented for the malfunctioning system. The second threshold value of pressure control 226 may be initially set to transition at the second documented high pressure for the system (i.e., the normal high pressure for the system). For example, if the high pressure before the condenser was cleaned was 250 psi and the high pressure after cleaning was 200 psi, then these can be used for the initial pressure control threshold values. (Often the second threshold value is set relative to the first, i.e., by the pressure differential.) In certain conditions the threshold values may need some adjustment because of variations in water temperature or suction pressure. To check for proper suction pressures for each type of refrigerant the technician can refer to a pressure temperature chart for that particular refrigerant.

The device 200 may be tested after calibration by temporarily blocking airflow to the system's air-cooled condenser 110, causing the pressure to rise. When the pressure reaches the high threshold value, the device should activate, opening the water valve 234 and turning on the warning light 244. The air-cooled condenser 110 is then un-blocked, allowing the pressure to drop. When the pressure drops below the second threshold value, the device should deactivate, closing the water valve 234 and turning off the warning light 244.

In another embodiment of the invention, the device 200 is connected so that the cycle by-passes the air-cooled condenser 110, thereby converting refrigeration system 210 from an air-cooled system to a water-cooled system. In other words, inlet 222 is connected to fluid line 150 just downstream from compressor 100, before air-cooled condenser 110. Outlet 228 is connected as before just upstream from receiver 120. Because air-cooled condenser 110 is by-passed, fan 160 (if present) may be disconnected. Alternatively, the device 200 may be connected as before, i.e., downstream from air-cooled condenser 110 without by-passing it, and the fan 160 disconnected. This results in an effective conversion since air-cooled condenser 110 will no longer provide the primary condensation for the refrigeration system. This installation has the advantage that it is simpler to connect than by-passing the condenser 110, and the air-cooled condenser 110 may still provide some small amount of condensation.

As will be evident from the foregoing description, embodiments of the present invention solve various long-standing problems in the art and enjoys many advantages.

For example, because water flows through the device only when needed, the device does not have high operating expenses and can be used in locations where the water supply is limited. In addition, the device does not use electrical power unless it is activated. The device is pre-wired, pre-piped, and easy to install. It does not require any electrical connections to the compressor and can be plugged in to any standard power outlet. It can also be easily disconnected from a refrigeration system that is replaced or that no longer needs it and reinstalled on another refrigeration system. The device is inexpensive and can be manufactured from components that are readily available. The device can be manufactured at various scales suitable for use with refrigeration systems of differing sizes. The device can also be made using any of various types of common heat exchangers, e.g., tube—tube type and coaxial type. More importantly, the device provides an inexpensive and easily installed way to quickly return a refrigeration system to normal operation whenever the system's air-cooled condenser fails. Once installed, the device also provides a back-up condenser which ensures that safe refrigeration temperatures are maintained in the appliance in the event that the primary air-cooled condenser fails. The device also has the advantage that a warning indicator provides an immediate alert that the air-cooled condenser has failed and requires attention. Meanwhile, the back-up water-cooled condenser will maintain safe operation temperatures within the refrigeration system, preventing loss of perishable items and reducing the likelihood of food poisoning and other serious consequences.

What is claimed is:

1. A device comprising:

a refrigerant fluid line comprising a refrigerant fluid inlet, a refrigerant fluid heat exchange section, a refrigerant fluid state sensor, and a refrigerant fluid outlet; and a water line comprising a water inlet, a controllable water flow valve, a water heat exchange section, and a water outlet, wherein the water heat exchange section and the refrigerant fluid heat exchange section are in heat exchange relationship;

wherein the refrigerant fluid state sensor and the controllable water flow valve are connected so that the water flow valve increases water flow when a sensed refrigerant fluid state rises and the water flow valve reduces water flow when the sensed refrigerant fluid state drops;

wherein the refrigerant fluid state sensor is positioned downstream from the refrigerant fluid heat exchange section.

2. The device of claim 1 wherein a flow of refrigerant in the refrigerant fluid heat exchange section has the same direction as a flow of water in the water heat exchange section.

3. The device of claim 1 wherein the refrigerant fluid state sensor provides an on/off output.

4. The device of claim 1 wherein the water flow valve comprises a solenoid valve.

5. The device of claim 1 further comprising a warning indicator.

6. The device of claim 1 wherein the warning indicator is a light.

7. A method comprising:

receiving into a device a refrigerant fluid from a high-pressure portion of a refrigeration system, wherein the device is external to the refrigeration system;

passing the received refrigerant fluid through a water-cooled condenser in the device;

sensing in the device a state of the refrigerant fluid downstream from the water-cooled condenser in the device;

increasing a flow of water through the water-cooled condenser in the device if the sensed state of the refrigerant fluid rises;

decreasing the flow of water through the water-cooled condenser in the device if the sensed state of the refrigerant fluid drops;

returning the refrigerant fluid from the device to the high-pressure portion of the refrigeration system.

8. The method of claim 7 wherein the refrigerant fluid is received from the high-pressure portion of the refrigeration system downstream from an air-cooled condenser in the refrigeration system.

9. The method of claim 7 wherein the refrigerant fluid is returned to the high-pressure portion of the refrigeration system upstream from a receiver in the refrigeration system.

10. The method of claim 7 wherein the flow of water through the water-cooled condenser is increased from OFF to ON when the sensed state of the refrigerant fluid rises above a first predetermined threshold value.

11. The method of claim 7 further comprising activating a warning indicator when the sensed state of the refrigerant fluid rises.

12. The method of claim 7 wherein the flow of water through the water-cooled condenser is decreased from ON to OFF when the sensed state of the refrigerant fluid drops below a second predetermined threshold value.

13. The method of claim 7 further comprising activating a warning indicator when the sensed state of the refrigerant fluid rises.

14. The method of claim 7 wherein the received refrigerant fluid is passed through the water-cooled condenser in the device such that the water and refrigerant fluid have the same flow directions in the condenser.

15. A device comprising:

a refrigerant fluid line comprising a refrigerant fluid inlet, a refrigerant fluid heat exchange section, a refrigerant fluid state sensor, and a refrigerant fluid outlet; and a water line comprising a water inlet, a controllable water flow valve, a water heat exchange section, and a water outlet, wherein the water heat exchange section and the refrigerant fluid heat exchange section are in heat exchange relationship;

wherein the refrigerant fluid state sensor and the controllable water flow valve are connected so that the water flow valve increases water flow when a sensed refrigerant fluid state rises and the water flow valve reduces water flow when the sensed refrigerant fluid state drops;

wherein the water flow valve increases water flow when a sensed refrigerant fluid state rises above a first threshold value and the water flow valve reduces water flow when the sensed refrigerant fluid state drops below a second threshold value.

* * * * *